US008038930B2

(12) United States Patent
Seppälä et al.

(10) Patent No.: US 8,038,930 B2
(45) Date of Patent: Oct. 18, 2011

(54) COOLING ELEMENT AND METHOD FOR MANUFACTURING THE SAME

(75) Inventors: Kai Seppälä, Espoo (FI); Jyrki Koitto, Virrat (FI); Risto Saarinen, Espoo (FI)

(73) Assignee: Outotec Oyj, Espoo (FI)

( * ) Notice: Subject to any disclaimer, the term of this patent is extended or adjusted under 35 U.S.C. 154(b) by 687 days.

(21) Appl. No.: 12/093,581

(22) PCT Filed: Nov. 23, 2006

(86) PCT No.: PCT/FI2006/000387

§ 371 (c)(1),
(2), (4) Date: May 13, 2008

(87) PCT Pub. No.: WO2007/063164

PCT Pub. Date: Jun. 7, 2007

(65) Prior Publication Data

US 2008/0272525 A1 Nov. 6, 2008

(30) Foreign Application Priority Data

Nov. 30, 2005 (FI) ..... 20051220

(51) Int. Cl.
*C21B 7/10* (2006.01)

(52) U.S. Cl. ..... 266/46; 266/47; 266/190; 266/193; 266/270; 148/519; 428/671; 428/674; 428/675

(58) Field of Classification Search ..... 266/46–67, 266/190, 193, 270; 148/519; 428/671, 674–675
See application file for complete search history.

(56) References Cited

U.S. PATENT DOCUMENTS

| | | | | |
|---|---|---|---|---|
| 5,139,814 | A * | 8/1992 | Sugao | 427/591 |
| 5,904,893 | A | 5/1999 | Stein | |
| 6,280,681 | B1 | 8/2001 | Macrae | |
| 6,619,067 | B2 * | 9/2003 | Hiramatsu | 62/354 |
| 2004/0139761 | A1 * | 7/2004 | Hiramatsu | 62/354 |

FOREIGN PATENT DOCUMENTS

| | | |
|---|---|---|
| EP | 1043085 | * 10/2000 |
| GB | 1386645 | * 3/1975 |
| JP | 51018357 | * 2/1976 |
| JP | 55005101 | 1/1980 |
| JP | 61123459 | 6/1986 |
| JP | 03264154 | * 11/1991 |
| WO | 0045978 | 8/2000 |
| WO | 2004057256 | 7/2004 |

* cited by examiner

*Primary Examiner* — Roy King
*Assistant Examiner* — Lois Zheng
(74) *Attorney, Agent, or Firm* — Chernoff, Vilhauer, McClung & Stenzel

(57) ABSTRACT

The invention relates to a cooling element to be used in the structure of a pyromettalurgical reactor used in the manufacturing of metals, which cooling element comprises a housing element mainly made of copper, provided with a channel system for the cooling medium circulation, made of pipe that is mainly made of copper; on the outer surface of the pipes forming the channel system, there is arranged a coating that has a lower melting point than the material of the housing element and the pipe. The invention also relates to a method for manufacturing the cooling element.

17 Claims, 2 Drawing Sheets

COOLING ELEMENT AND METHOD FOR MANUFACTURING THE SAME

Figure 1:
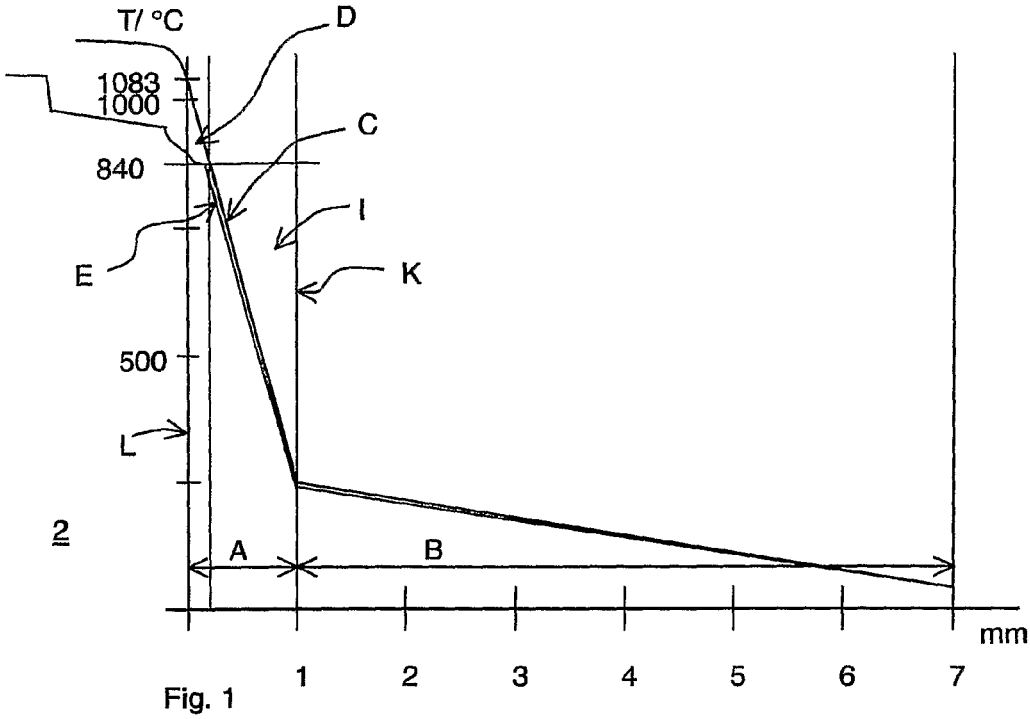

This is a national stage application filed under 35 USC 371 based on International Application No. PCT/FI2006/000387 filed Nov. 23, 2006, and claims priority under 35 USC 119 of Finnish Patent Application No. 20051220 filed Nov. 30, 2005.

The present invention relates to a cooling element used in the structure of a pyrometallurgical reactor and to a method for manufacturing said cooling element.

In pyrometallurgical processes, reactor linings are protected by water-cooled cooling elements, so that owing to the cooling, the heat emitted on the lining surface is through the cooling element transferred to water, in which case the wearing of the lining is essentially reduced in comparison with a reactor that has not been cooled. The reduction in wearing is achieved by the so-called autogenous lining solidified on the surface of the refractory lining, which autogenous lining is formed by slag and other molten phases. The cooling element should have a good heat transfer capacity, and the elements should resist the sudden temperature changes of metallurgic furnaces and generally high temperatures.

Conventionally cooling elements can be manufactured for example by sand casting, where in a mold made in sand, there is arranged a cooling pipework made of a material such as copper with a good heat transfer capacity, and during the casting process carried out around said pipework, the pipework is cooled either by air or by water. Also the element cast around the pipework is made of a material with a good heat conductive capacity, preferably copper. This kind of manufacturing method is described for instance in the GB patent 1386645. Also the U.S. Pat. No. 5,904,893 describes a cooling element used in metallurgic furnaces and the manufacturing thereof. According to said publication, a cooling element made of copper is made by casting the copper in a copper mold around the cooling pipework. Because the material to be cast and the cooling pipe are made of the same material, the described method has several remarkable drawbacks. The major problem of said method is that the pipework serving as the flow channel is attached unevenly to the surrounding casting material, because part of the pipes can be completely detached of the surrounding cast element, and part of the pipe can be completely molten and thus damaged. If a metallic bond is not created between the cooling pipe and the rest of the element cast around it, heat transfer is not effective between the cooling element and the cooling medium. Thus also the heat resistance of the cooling element is weakened. If again the pipework melts completely, it prevents the passage of the cooling water.

The publication U.S. Pat. No. 6,280,681 B1 describes a cooling element where various different materials, such as copper-nickel alloys, are suggested to be used in the cooling pipes. However, in that case the achieved heat transfer between the cooling element and the cooling liquid is not as good as when using copper pipes.

In addition, from the publication WO 2004057256 there is known a cooling element and method for manufacturing the same, where the cooling pipes of a cooling element made of copper or copper alloy are electrolytically coated by a thin metal layer, such as nickel.

The object of the present invention is to eliminate some of the drawbacks of the prior art and to realize a new type of cooling element to be used in the structure of a pyrometallurgical reactor meant for the manufacturing of metals, so that a good heat transfer is achieved between the cooling element and the cooling pipe. In addition, the object of the invention is to realize a method for manufacturing said cooling element. The essential novel features of the invention are apparent from the appended claims.

The invention brings forth remarkable advantages. The invention relates to a cooling element to be used in the structure of a pyrometallurgical reactor meant for the manufacturing of metals, said cooling element comprising a housing element mainly made of copper, provided with a channel system compiled of pipes mainly made of copper for the cooling medium circulation, so that on the outer surface of the pipes constituting the channel system there is arranged a coating with a melting point that is lower than with the material of the housing element and the pipe. In this connection, copper means mainly pure copper, such as copper deoxidized with phosphorus that is most generally used in cooling elements. According to an embodiment of the invention, the coating is an alloy where copper is alloyed with at least one ingredient that lowers its melting point, in which case there is advantageously achieved a bronze contact with a good heat transfer capacity between the pipe and the housing element, i.e. heat is transferred more effectively from the cooling element to the cooling medium. According to an embodiment, the coating is an alloy of copper, tin and/or silver. According to another embodiment, the coating is copper with a tin content of 10%. According to the invention, the coating can also be copper with 10% silver, or an alloy of copper, lead and tin. According to a preferred embodiment, the coating is silver, which is known to have a lower melting point (961° C.) than copper (1083° C.). The thickness of the coating according to the invention is advantageously 0.1-1 millimeters, in which case the border surface between the pipe and the coating is protected against melting during the casting of the housing element.

According to the invention, the housing element of the cooling element is cast around pipes, in which case there is arranged circulation of the cooling medium, such as pressurized water, in the pipes during the casting of the housing of the cooling element, so that the border surface between the pipe and the coating remains solid, and that the pipe should not be damaged during the casting process owing to heat. The cooling in the pipes is arranged by means of circulating water to be so effective that melting does not take place in the contact surface between the copper pipe and the coating, but that coalescence does take place in the contact surface between the coating and the molten copper, which coalescence enhances the creation of a good metallurgic contact. The pipes are coated prior to the casting of the cooling element, and the pipes are designed in the desired shape either before or after the coating. When the cast housing element of the cooling element is solidified around the pipes and the coating, the cooling in the pipes is stopped, and the coating forms an advantageous contact surface between the housing element of the cast cooling element and the outer surface of the pipes. When the coating includes as an alloying ingredient a metal with a good solubility into copper, this enhances the creation of the contact surface. By means of the invention, there is realized a coating that is metallurgically well attached around the pipe, in which coating the ingredient alloyed in copper for lowering its melting point enhances the creation of a durable bond. By means of the coating according to the invention, there is achieved a contact surface that has good heat transfer capacities and good durability between the cooling element and the pipe, which surface surrounds the pipe along its whole outer surface. Generally the shape and size of the cooling element are dependent of the target of usage in each case.

According to an embodiment of the invention, the pipes are coated by melt coating, in which case they are immersed in molten coating material. According to an embodiment, the coating is made by electrolytic coating. According to an embodiment, the pipes are coated by thermal spraying technique, such as flame spraying, so that as the mixture of combustion gas and oxygen burns, it melts the coating material that has the shape of wire or powder. The molten coating is blown as pressurized on the surface of the pipes by means of a certain type of nozzle system. In an embodiment of the invention, the cooling element is the surrounding element of the taphole meant for tapping the melt, in which case at least part of the cooling element is arranged essentially to surround the taphole.

Figure 2:
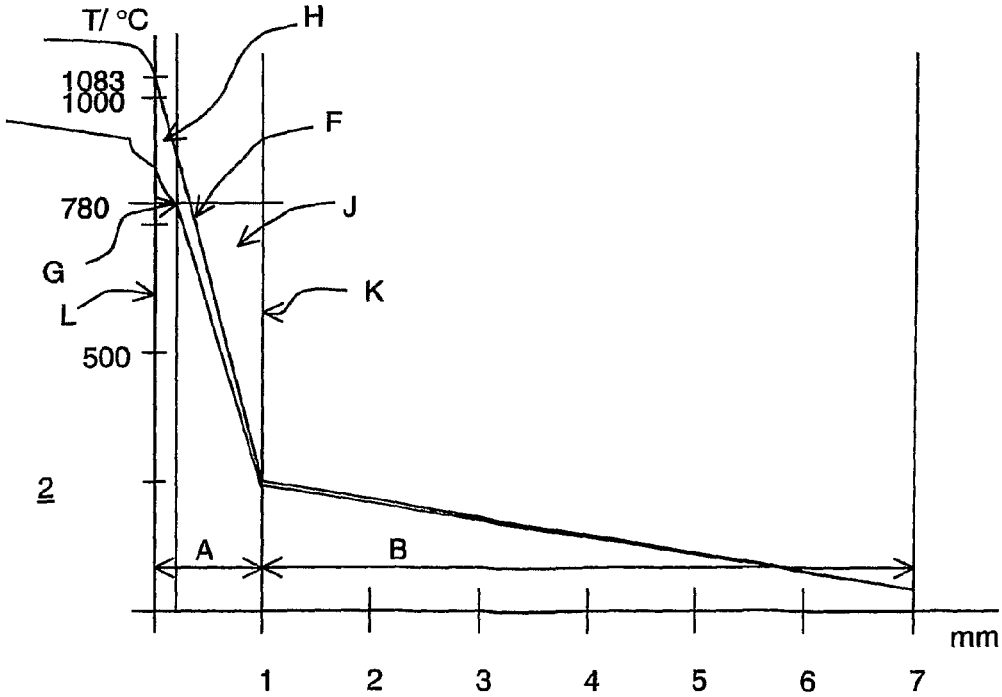
Figure 3A:
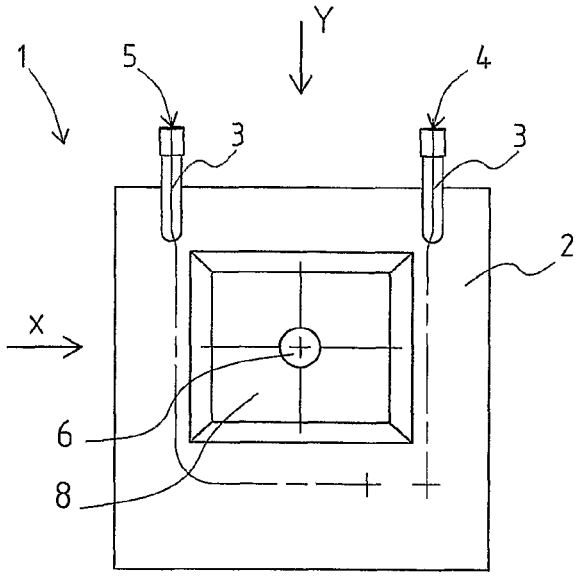
Figure 3B:
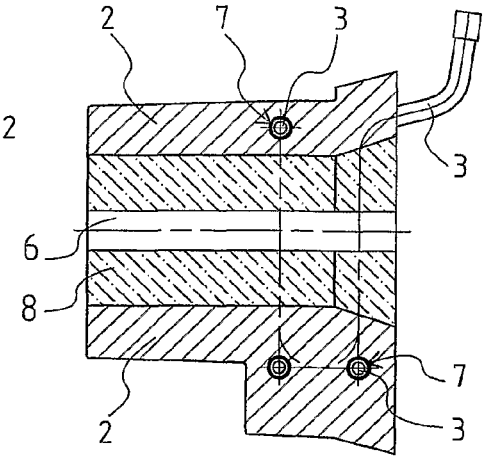
Figure 3C:
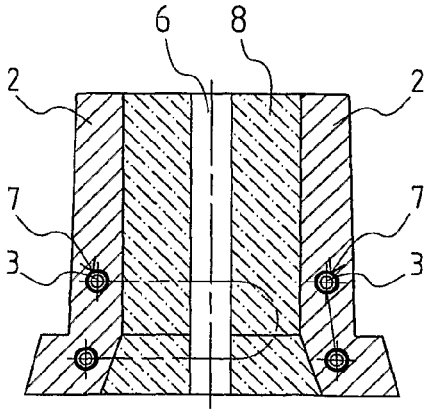

The invention is explained in more detail with reference to the appended drawings, wherein FIG. 1 illustrates how the temperature is distributed in a cooling element according to the invention, when the coating is copper with 10 percent tin;

FIG. 2 illustrates how the temperature is distributed in a cooling element according to the invention, when the coating is copper with 10 percent silver; and FIGS. 3*a*, 3*b* and 3*c* illustrate a cooling element according to the invention.

FIGS. 1 and 2 illustrate how the temperature T behaves in the coating A of the pipes cast inside the housing element 2 of the cooling element and in the pipe wall B. In FIG. 1, the exemplary coating material is an alloy where copper is alloyed by 10% of tin, and in FIG. 2 there is illustrated an alloy where copper is alloyed by 10% silver. According to the example, the thickness A of the coating is 1 millimeter, and the thickness B of the pipe wall is 6 millimeters. Inside the pipe, there is arranged the circulation of the cooling medium, such as water, in order to prevent the border surface K between the pipe and the coating from melting owing to the temperature of the housing element 2, but for keeping it solid. In FIG. 1, the curve C and in FIG. 2 the curve F describe the temperature gradient at the beginning of the casting process in the coating A, between the contact surface L between the housing element 2 to be cast and the coating, and between the contact surface K between the wall and the coating, and in the wall B of the pipe. During the casting process, the temperature of the copper housing element 2 rises above its melting point (1083° C.). Owing to the cooling medium circulation, the temperature drops in the coating A, when proceeding towards the contact surface K between the pipe and the coating. The regions D and H describe how the copper and the alloying ingredient are coalescenced on the outer surface of the coating. Coalescence takes place, because the temperature in this outermost layer of the coating is higher than the solidus temperature of the coating alloy (840° C. for a Cu—Sn alloy, and 780° C. for a Cu—Ag alloy). The regions I and J describe solid regions in the layer of the coating A that falls on the side of the wall B. In FIGS. 1 and 2, the curves E and G describe the temperature gradient in the coating A and in the pipe wall B in a later stage of the casting process, when the cast copper housing element 2 in the vicinity of the cooling pipes already is solidified. At this stage, both the copper housing element and the copper pipe are in solid state, and the cooling medium circulation can be closed off. However, the pipe coating A is still partly molten, because the temperature is higher than the solidus temperature of the coating. The partly molten coating is solidified as the cast object is further cooled, thus creating a close contact with good heat transfer capacities between the cast copper housing element and the cooling pipe.

In FIGS. 3*a*, 3*b* and 3*c*, there is by way of example illustrated a cooling element 1 according to the invention. FIG. 3*b* is a cross-section in the direction X of FIG. 3*a*, and FIG. 3*c* is a cross-section of FIG. 3*a* in the direction Y. According to the example, the cooling element is an element surrounding the taphole 6 used in a pyrometallurgical reactor for tapping molten metal, in which case it protects the refractory ceramic linings 8 surrounding the taphole 6 from being damaged during the tapping of the high-temperature melt. The housing element 2 of the cooling element is made of pure copper where the oxygen content is minimized. Inside the cooling element 1, there are arranged copper pipes 3 made for the cooling medium circulation, which pipes are so designed, that they surround the taphole 6 for achieving a maximal cooling effect. For the cooling medium, there are provided inlet and outlet apertures 4 and 5 for circulating the medium in and out of the pipes 3. When manufacturing the cooling element, the cooling medium according to the invention is water, which is pressurized into the pipes at a pressure of about 6 bar, in order to achieve an efficient cooling effect in the coating 7 and the pipe 3 before the cast is solidified. The employed pipe is any thick-walled copper pipe that is in measures suited for the purpose of usage; the inner diameter of the pipe in the example is 24 millimeters. On the surface of the pipes 3, there is provided a coating 7 for realizing a durable contact with a good heat transfer capacity between the housing element 2 of the copper cooling element and the copper pipe 3. The employed coating material is an alloy where copper is alloyed by at least one ingredient that drops its melting point in order to achieve a bronze contact with advantageous heat transfer capacities between the pipe and the housing element.

For a man skilled in the art, it is obvious that the various embodiments of the invention are not restricted to those explained above, but may vary within the scope of the appended claims.

The invention claimed is:

1. A cooling element for use in connection with a pyrometallurgical reactor for manufacture of metals, which cooling element comprises a housing element mainly made of copper and provided with a channel system for circulation of a cooling medium, wherein the channel system comprises piping mainly made of copper and having an outer surface coating of copper that is alloyed with at least one ingredient such that the coating has a melting point that is lower than that of the material of the housing element and lower than that of the material of the piping, and wherein the coating is 0.1-1 mm in thickness.

2. A cooling element according to claim 1, wherein the coating is an alloy of copper, tin and/or silver.

3. A cooling element according to claim 1, wherein the coating is copper with a 10% tin content.

4. A cooling element according to claim 1, wherein the coating is copper with a 10% silver content.

5. A cooling element according to claim 1, wherein the coating is an alloy of copper, lead and tin.

6. A method for manufacturing a cooling element for use in connection with a pyrometallurgical reactor for manufacture of metals, which cooling element comprises a housing element mainly made of copper and provided with a channel system for circulation of a cooling medium, wherein the cooling system comprises piping mainly made of copper, wherein the method comprises:

providing the piping with an outer surface coating of copper that is alloyed with at least one ingredient such that the coating has a melting point that is lower than that of the material of the housing element and lower than that of the material of the piping, and wherein the coating is 0.1-1 mm in thickness, and subsequently casting the housing element around the piping of the cooling element.

7. A method according to claim 6, comprising cooling the piping with a cooling medium during casting of the housing element, so that the contact surface between the outer surface coating and the piping remains solid.

8. A method according to claim 6, comprising cooling the piping by circulation of a cooling medium during casting of the housing element, so that the contact surface between the outer surface coating and the piping remains solid, and stopping the circulation of the cooling medium in the piping when the housing element solidifies.

9. A method according to claim 6, comprising forming the coating by melt coating.

10. A method according to claim 6, comprising forming the coating by electrolytic coating.

11. A method according to claim 6, comprising forming the coating by thermal spraying technique.

12. A method according to claim 6, wherein the coating is an alloy of copper, tin and/or silver.

13. A method according to claim 6, wherein the coating is copper alloyed with 10% tin.

14. A method according to claim 6, wherein the coating is copper alloyed with 10% silver.

15. A method according to claim 6, wherein the coating is an alloy of copper, lead and tin.

16. A pyrometallurgical reactor for manufacture of metals, the reactor having a taphole for tapping molten metal from the reactor, and wherein the reactor comprises a cooling element that surrounds the taphole and comprises a housing element mainly made of copper and provided with a channel system for circulation of a cooling medium, wherein the channel system comprises piping mainly made of copper and having an outer surface coating of copper that is alloyed with at least one ingredient such that the coating has a melting point that is lower than that of the material of the housing element and lower than that of the material of the piping, and wherein the coating is 0.1-1 mm in thickness.

17. A pyrometallurgical reactor according to claim 16, wherein the taphole is surrounded by a refractory ceramic lining and the refractory ceramic lining is surrounded by the cooling element for protecting the ceramic lining from damage during tapping of molten metal from the reactor.

* * * * *